US010600587B2

(12) United States Patent
Patwardhan et al.

(10) Patent No.: US 10,600,587 B2
(45) Date of Patent: Mar. 24, 2020

(54) ELECTRICAL SWITCHING APPARATUS AND TRANSFER ASSEMBLY THEREFOR

(71) Applicant: EATON INTELLIGENT POWER LIMITED, Dublin (IE)

(72) Inventors: Sujit Subhash Patwardhan, Maharashtra (IN); Ramesh Shivaji Powar, Maharashtra (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/038,815

(22) Filed: Jul. 18, 2018

(65) Prior Publication Data

US 2020/0027670 A1 Jan. 23, 2020

(51) Int. Cl.

| | |
|---|---|
| ***H01H 9/22*** | (2006.01) |
| ***H01H 9/28*** | (2006.01) |
| ***H01H 19/635*** | (2006.01) |

(52) U.S. Cl.

CPC ..... *H01H 9/282* (2013.01); *H01H 9/22* (2013.01); *H01H 19/635* (2013.01)

(58) Field of Classification Search

CPC ..... H01H 9/22; H01H 71/56; H01H 11/0018; H01H 2071/565; H01H 3/10; H01H 71/0207; H01H 3/08; Y10T 74/18096; Y10T 74/18088; Y10T 74/1967; Y10T 74/20012; Y10T 74/18224; Y10T 74/1532

See application file for complete search history.

(56) References Cited

U.S. PATENT DOCUMENTS

| | | | | |
|---|---|---|---|---|
| 2,368,083 | A | 1/1945 | Adam | |
| 3,171,908 | A | 3/1965 | Malota | |
| 3,260,808 | A | 7/1966 | Dimond et al. | |
| 3,324,259 | A | 6/1967 | Chamberlin, Jr. et al. | |
| 5,219,070 | A | 6/1993 | Grunert et al. | |
| 6,194,983 | B1 * | 2/2001 | Bogdon | G05G 1/04 200/329 |
| 6,518,526 | B2 | 2/2003 | Hamada et al. | |
| 6,969,813 | B1 | 11/2005 | Winslett et al. | |

* cited by examiner

*Primary Examiner* — Ahmed M Saeed

(74) *Attorney, Agent, or Firm* — Eckert Seamans Cherin & Mellott, LLC

(57) ABSTRACT

A transfer assembly is for an electrical switching apparatus. The electrical switching apparatus has a first housing, separable contacts internal the first housing, and an operating handle having an ON position and an OFF position. The transfer assembly includes a rotary handle, a number of transfer components each structured to cooperate with the rotary handle, one of the transfer components being structured to engage the operating handle in order to allow the rotary handle to move the operating handle between the ON position and the OFF position, and a support assembly. The support assembly includes a second housing and a support member coupled to and located internal with respect to the second housing, the second housing being structured to be coupled to the first housing, the rotary handle being coupled to the second housing. Each of the transfer components is coupled to the support member.

14 Claims, 9 Drawing Sheets

ELECTRICAL SWITCHING APPARATUS AND TRANSFER ASSEMBLY THEREFOR

BACKGROUND

Field

The disclosed concept relates to electrical switching apparatus such as, for example, circuit breakers. The disclosed concept also relates to transfer assemblies for circuit breakers.

Background Information

Electrical switching apparatus include, for example, circuit switching devices; circuit interrupters such as circuit breakers; network protectors; contactors; motor starters; motor controllers; and other load controllers. Circuit breakers are used to protect electrical circuitry from damage due to an overcurrent condition, such as an overload condition or a relatively high level short circuit or fault condition. One known drawback of circuit breakers is that operating handles (e.g., operating handles used to open and close separable contacts of circuit breakers) can be difficult to manually move between positions. As a result, it is desirable to more easily move the operating handles between positions.

There is therefore room for improvement in electrical switching apparatus and in transfer assemblies therefor.

SUMMARY

These needs and others are met by embodiments of the disclosed concept, which are directed to an improved electrical switching apparatus and transfer assembly therefor.

In accordance with one aspect of the disclosed concept, a transfer assembly for an electrical switching apparatus is provided. The electrical switching apparatus has a first housing, a pair of separable contacts located internal with respect to the first housing, and an operating handle having an ON position and an OFF position, the ON position corresponding to the separable contacts being closed, the OFF position corresponding to the separable contacts being open. The transfer assembly includes a rotary handle; a number of transfer components each structured to cooperate with the rotary handle, one of the transfer components being structured to engage the operating handle in order to allow the rotary handle to move the operating handle between the ON position and the OFF position; and a support assembly having a second housing and a support member coupled to and located internal with respect to the second housing, the second housing being structured to be coupled to the first housing, the rotary handle being coupled to the second housing. Each of the transfer components is coupled to the support member.

In accordance with another aspect of the disclosed concept, an electrical switching apparatus includes a first housing; a pair of separable contacts located internal with respect to the first housing; an operating handle having an ON position and an OFF position, the ON position corresponding to the separable contacts being closed, the OFF position corresponding to the separable contacts being open; and the aforementioned transfer assembly.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the statement that two or more parts are "coupled" or "connected" together shall mean that the parts are joined together either directly or joined through one or more intermediate parts.

As employed herein, the term "number" shall mean one or an integer greater than one (i.e., a plurality).

As employed herein, the term "coupling member" refers to any suitable connecting or tightening mechanism expressly including, but not limited to, zip ties, wire ties, rivets, screws, bolts, the combination of bolts and nuts (e.g., without limitation, lock nuts), and washers and nuts.

As employed herein, the statement that two or more parts or components "engage" one another shall mean that the parts exert a force against one another either directly or through one or more intermediate parts or components.

As employed herein, the term "coupling member" refers to any suitable connecting or tightening mechanism expressly including, but not limited to, zip ties, wire ties, rivets, screws, bolts, the combination of bolts and nuts (e.g., without limitation, lock nuts), and washers and nuts.

Figure 1:
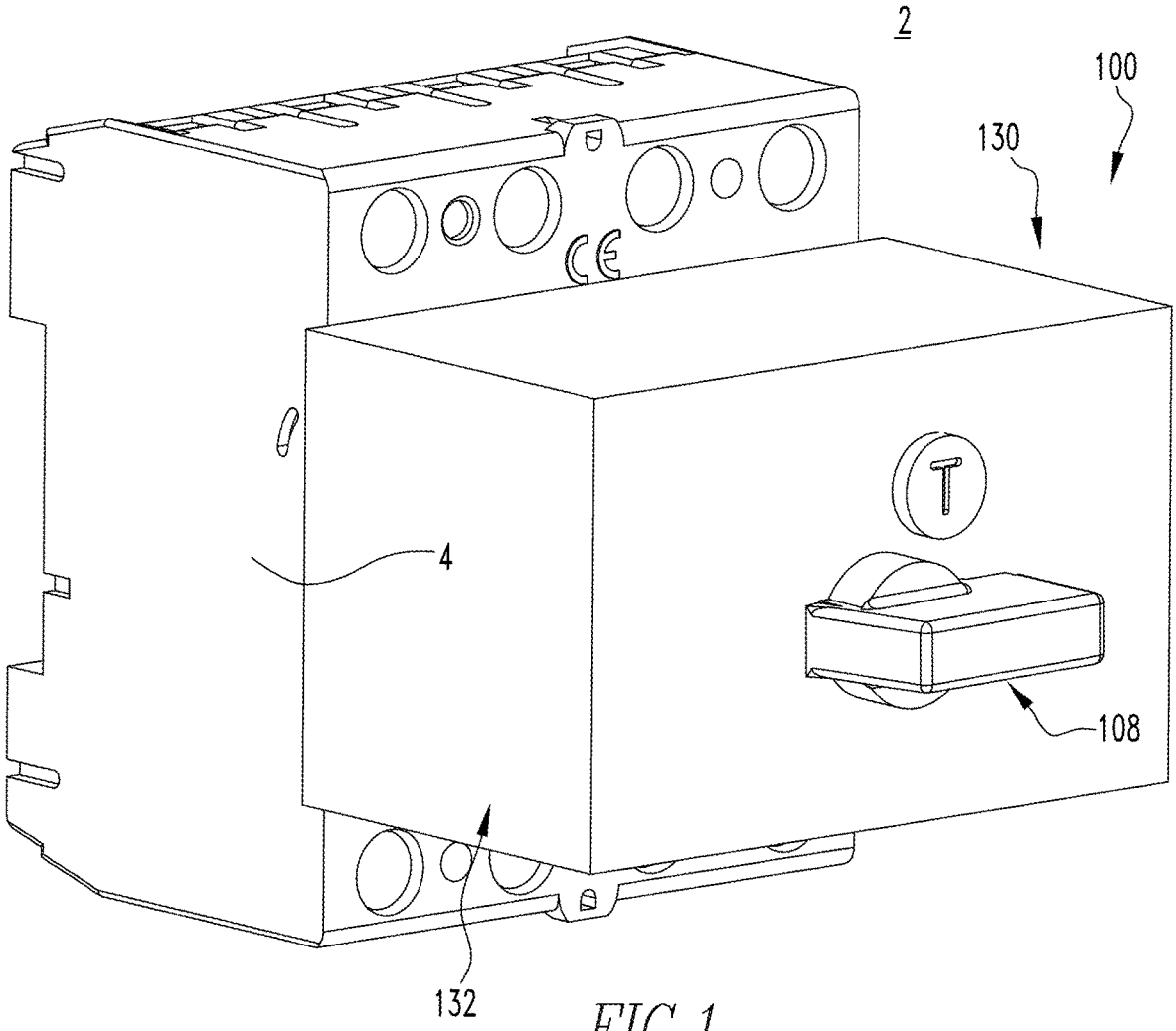
FIG. 1 is an isometric view of an electrical switching apparatus and transfer assembly therefor, shown in an OFF position, in accordance with one non-limiting embodiment of the disclosed concept.
Figure 2:
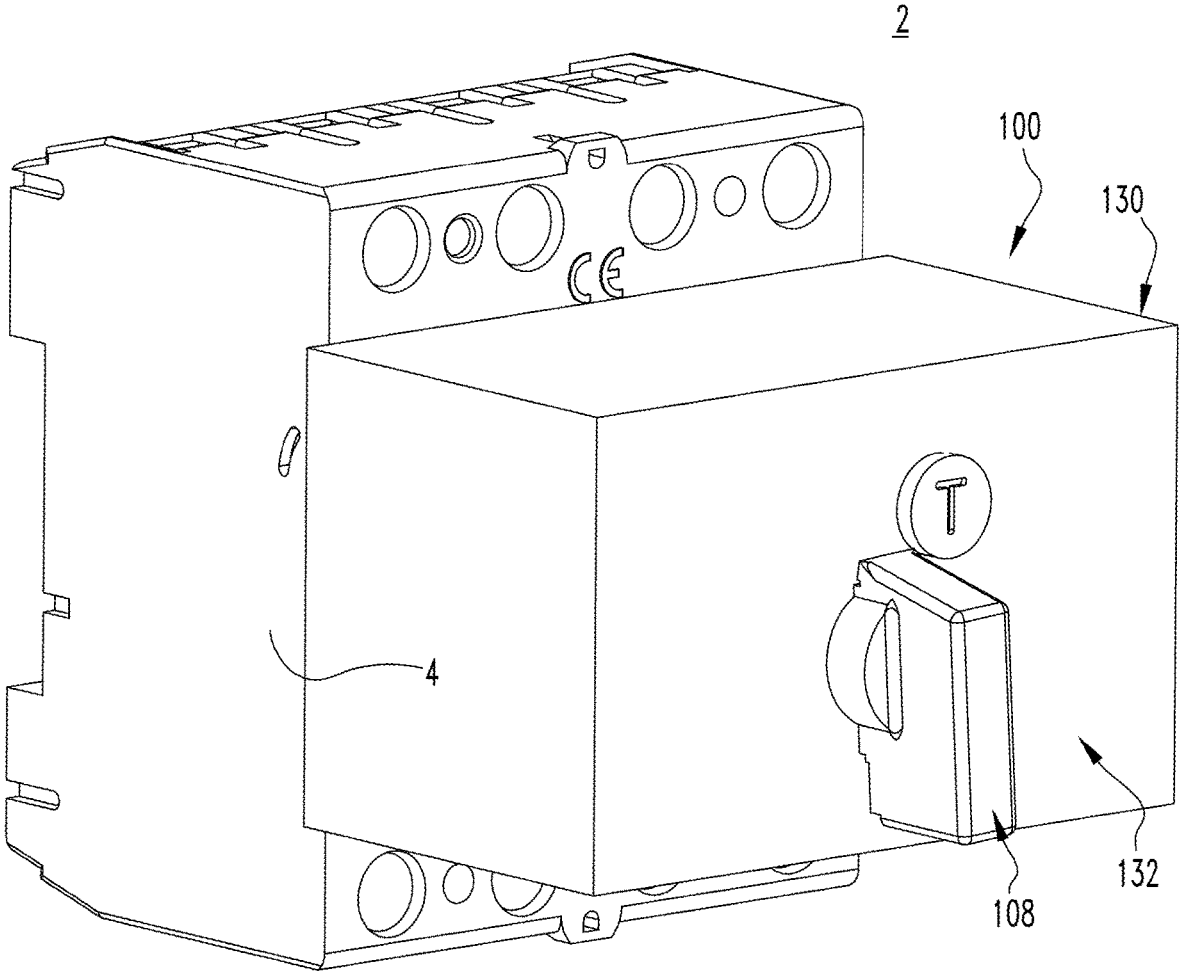
FIG. 2 is an isometric view of the electrical switching apparatus and transfer assembly therefor of FIG. 1, shown in the ON position.
Figure 3:
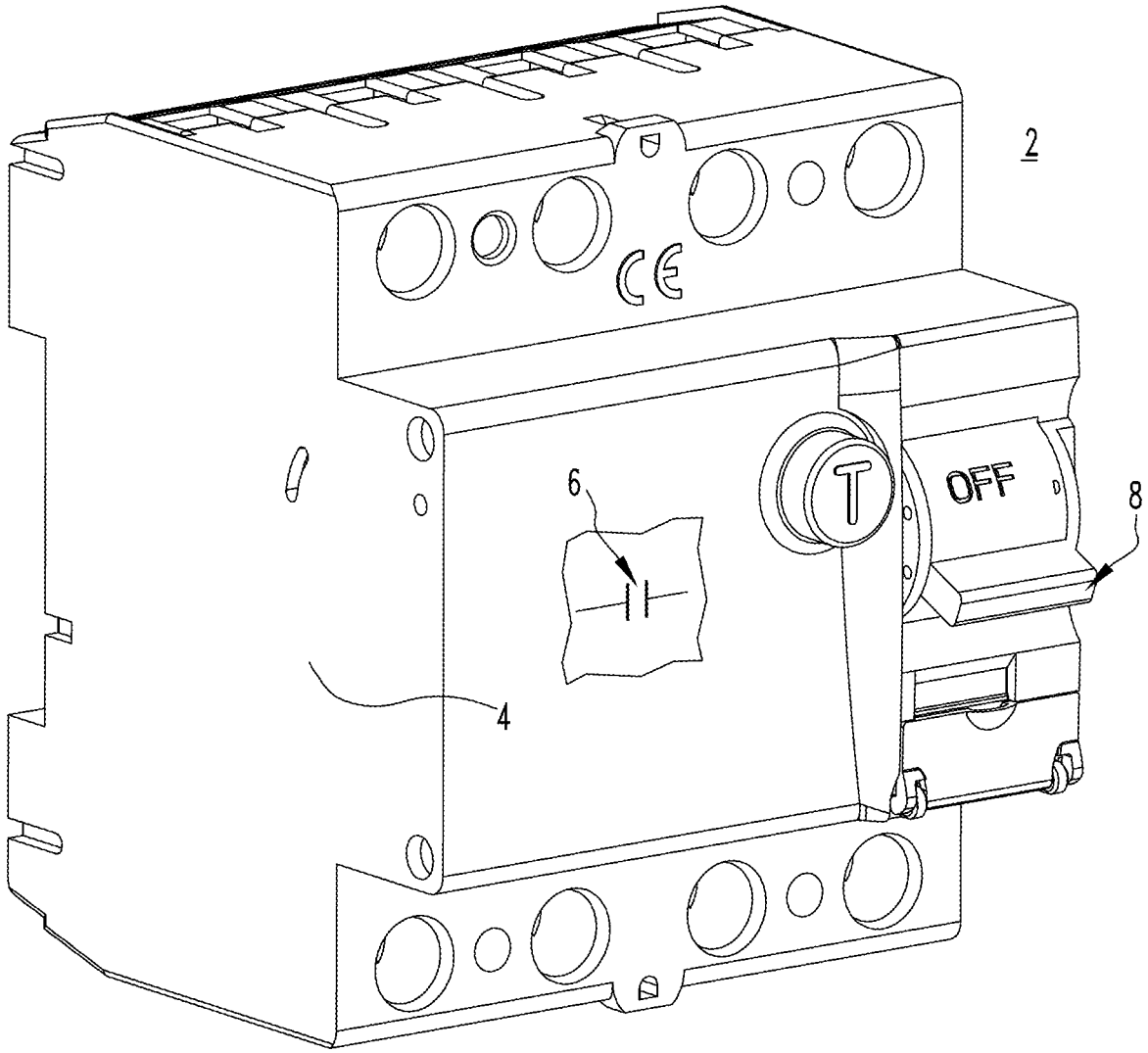
FIG. 3 is a partially simplified isometric view of a portion of the electrical switching apparatus of FIG. 1, shown with an operating handle in an OFF position.
Figure 4:
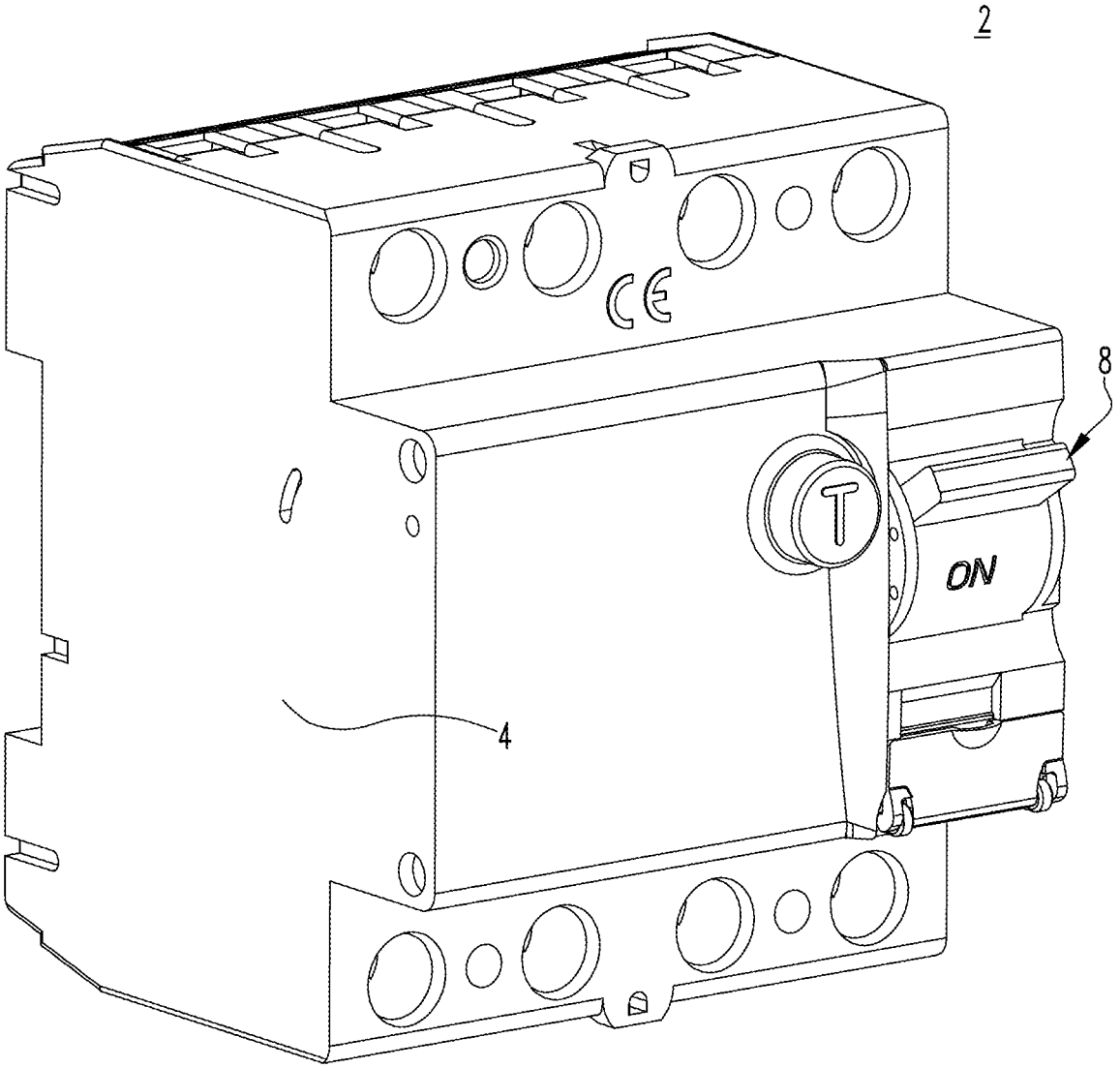
FIG. 4 is another isometric view of the portion of the electrical switching apparatus of FIG. 1, shown with the operating handle in an ON position.

FIGS. 1 and 2 are front isometric views of an electrical switching apparatus (e.g., without limitation, residual current circuit breaker 2) and transfer assembly 100 therefor, in OFF and ON positions, respectively, in accordance with one non-limiting embodiment of the disclosed concept. FIGS. 3 and 4 show isometric views of the circuit breaker 2 without the transfer assembly 100. As shown in FIG. 3, the circuit breaker 2 includes a housing 4, a pair of separable contacts 6 (shown in simplified form) located internal with respect to the housing 4, and an operating handle 8 having OFF and ON positions. The OFF position corresponds to the separable contacts 6 being open, and the ON position corresponds to the separable contacts 6 being closed.

Referring again to FIGS. 1 and 2, it will be appreciated that the transfer assembly 100 is configured to move the operating handle 8 (FIGS. 3 and 4) between positions in a relatively easy manner. For example, the transfer assembly 100 includes a rotary handle 108 structured to cooperate with the operating handle 8 (FIGS. 3 and 4). As will be discussed below, relatively easy (e.g., with less effort than direct movement of the operating handle 8) rotation of the rotary handle 108 by the operator is configured to move the relatively difficult to move operating handle 8 between positions. Furthermore, the transfer assembly 100 includes a novel mechanism to provide strength and support to components associated with transferring motion from the rotary handle 108 to the operating handle 8 (FIGS. 3 and 4).

In addition to the rotary handle 108, the transfer assembly 100 further includes a number of transfer components (e.g., without limitation, sliding member 110 and gear members 112,114, shown in FIGS. 6, 8, 9, and 10) and a support assembly 130. The support assembly 130 includes a housing 132 and a support member 134 (FIGS. 5-8), each being separate and distinct components. The housing 132 is preferably made of a non-metallic material, and the support member 134 is preferably made of a metallic material. The rotary handle 108 is coupled to the housing 132. As will be discussed below, the support member 134 is advantageously configured to provide significant support to the rotary handle 108, sliding member 110, and gear members 112,114 when they move in operation.

Figure 5:
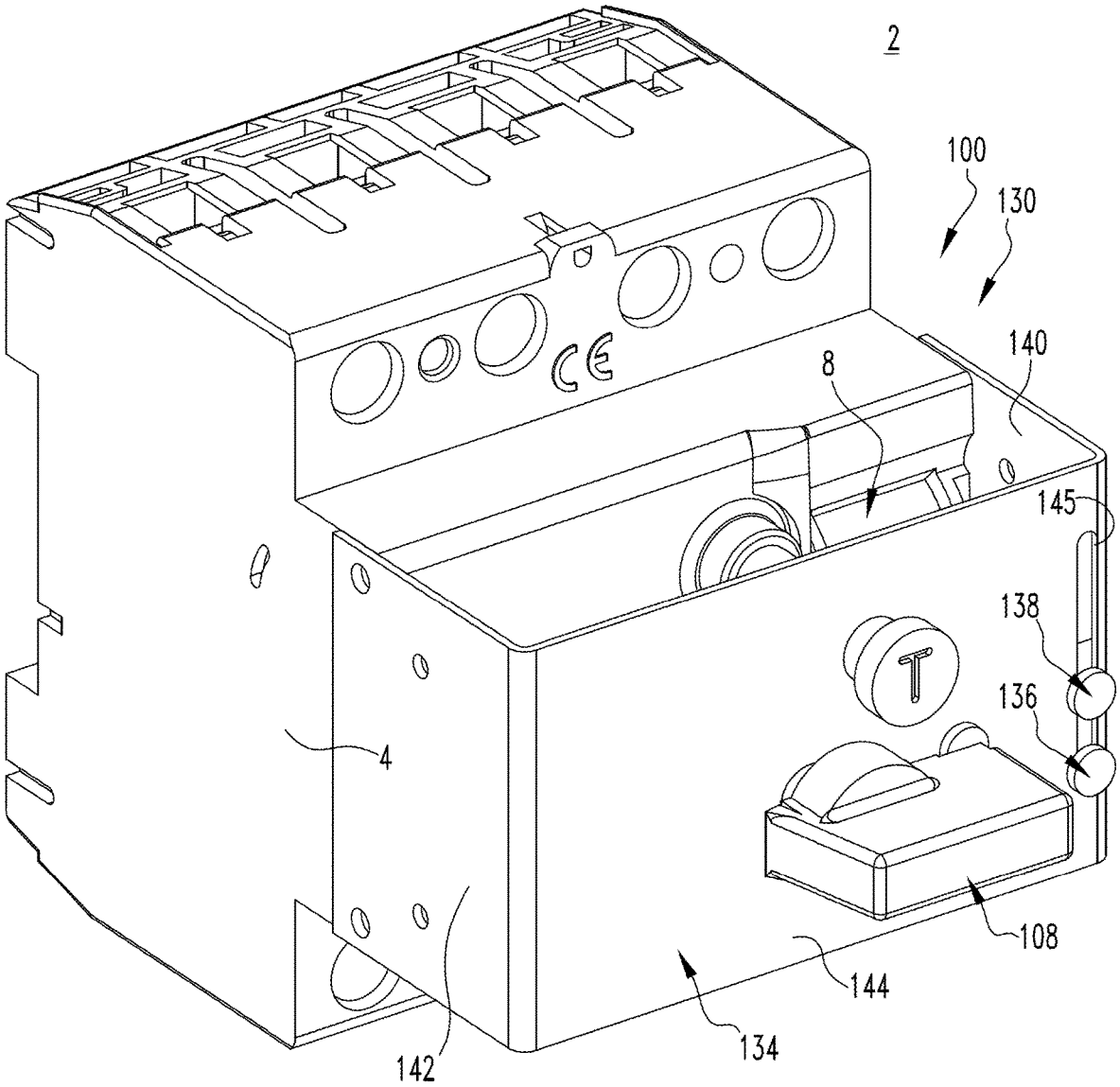
FIG. 5 is an isometric view of the electrical switching apparatus and transfer assembly therefor of FIG. 3, shown without a housing of the transfer assembly in order to see hidden structures.

Referring to FIG. 5, the support member 134 includes a first wall 140, a second wall 142 located opposite and generally parallel to the first wall 140, and a third wall 144 extending between and being generally perpendicular to the first and second walls 140,142. In one example embodiment, the first and second walls 140,142 are coupled to the housing 4 of the circuit breaker 2. It will be appreciated that the first and second walls 140,142, which may be positioned so that the housing 4 is located between them, are coupled to the housing 4 by any suitable mechanism known in the art (e.g., without limitation, via a snap-fit mechanism with the housing 4, and/or via coupling members (not shown)). In this manner, and as will be discussed below, components (e.g., rotary handle 108, sliding member 110 and gear members 112,114) anchored either directly or indirectly to the support member 134 will be provided with significant additional structural support.

Continuing to refer to FIG. 5, the support assembly 130 further includes a number of coupling members 136,138 extending through the support member 134 and at least partially into the sliding member 110 in order to couple the sliding member 110 to the support member 134. As shown, the third wall 144 has an elongated slot 145 at or about a junction with the first wall 140, and the coupling members 136,138 extend through the slot 145.

Figure 6:
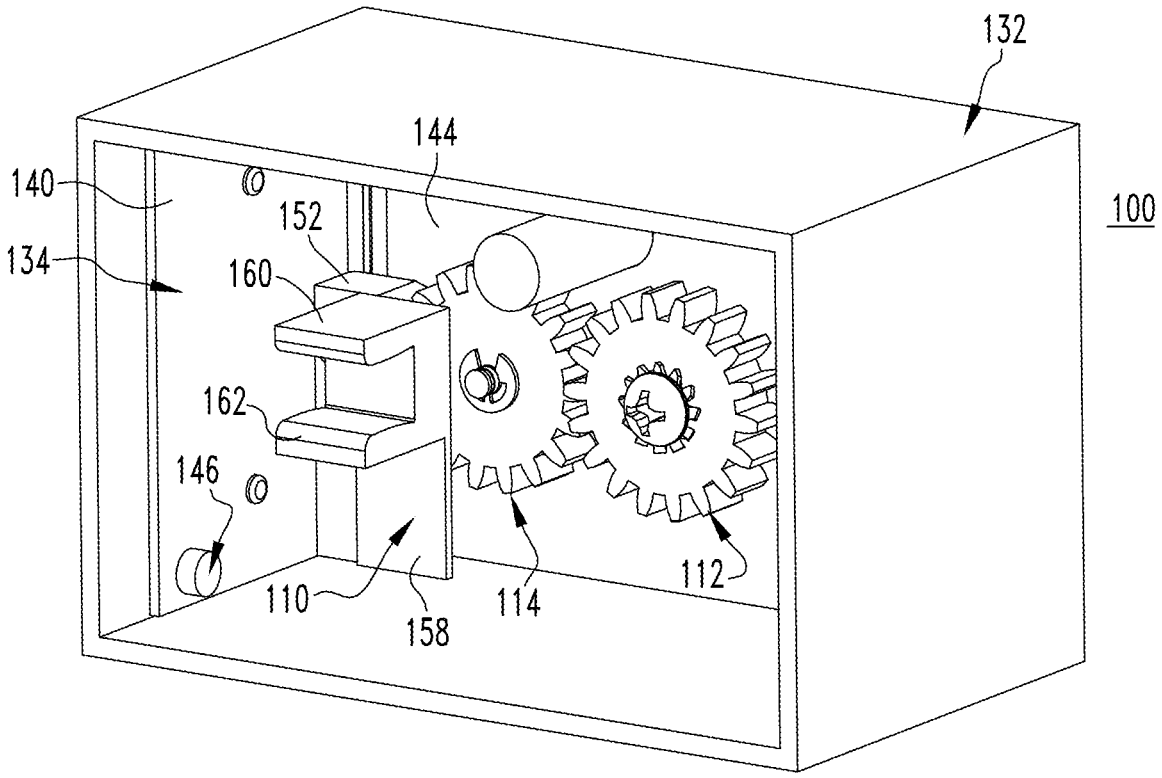
FIG. 6 is a rear isometric view of the transfer assembly of FIG. 3.

Referring to FIG. 6, the support member 134 is coupled to and located internal with respect to the housing 132, which is also coupled to the housing 4 of the circuit breaker 2. In one example embodiment, the support assembly 130 further includes a number of coupling members (only one coupling member 146 is shown in FIG. 6) extending at least partially through the housing 132 and the support member 134 in order to couple the support member 134 to the housing 132. As such, the first and second walls 140,142 each engage and are substantially flush with a corresponding wall of the housing 132. It can also be seen that in addition to the sliding member 110 being coupled to the support member 134, the gear members 112,114 are likewise coupled to the support member 134. The sliding member 110 and the gear members 112,114 are also each spaced from the first and second walls 140,142, with the sliding member 110 being located at or about the first wall 140 and opposite and distal the second wall 142. Additionally, the sliding member 110 and the gear members 112,114 are each structured to cooperate with the rotary handle 108 (FIGS. 1 and 2). Specifically, movement of the rotary handle 108 causes the sliding member 110 to engage the operating handle 8 (FIGS. 3 and 4) in order to allow the rotary handle 108 to move the operating handle 8 between the ON position and the OFF position.

Figure 7:
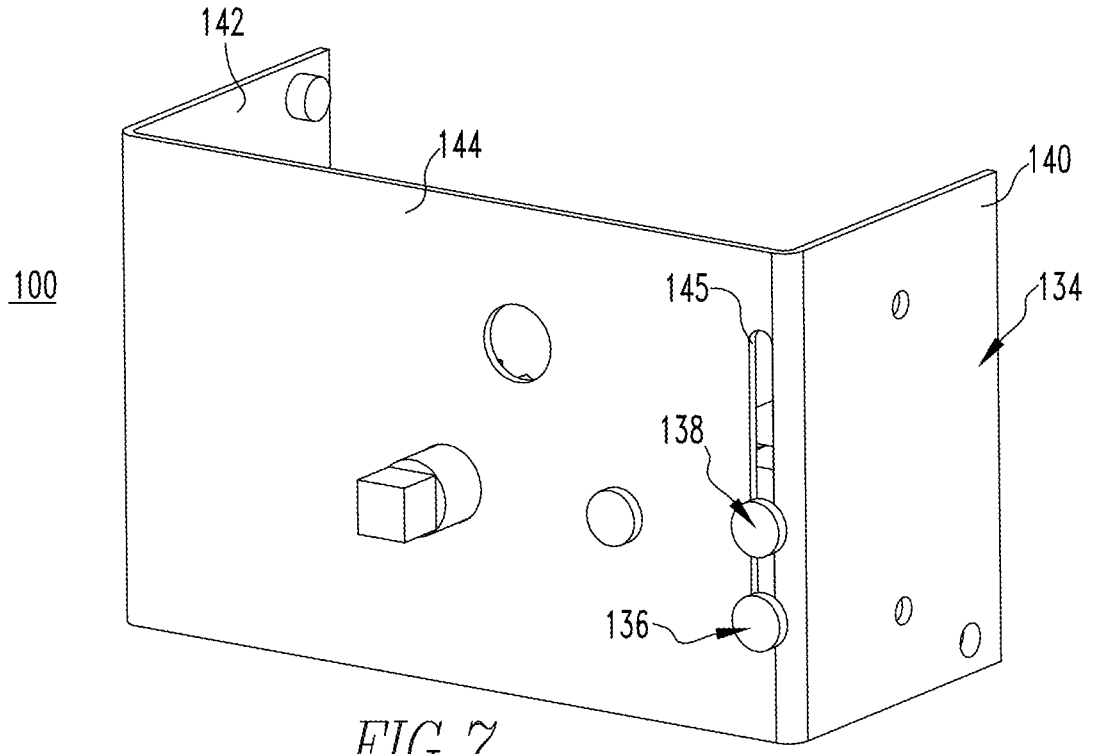
FIG. 7 is a front isometric view of a portion of the transfer assembly of FIG. 6.
Figure 8:
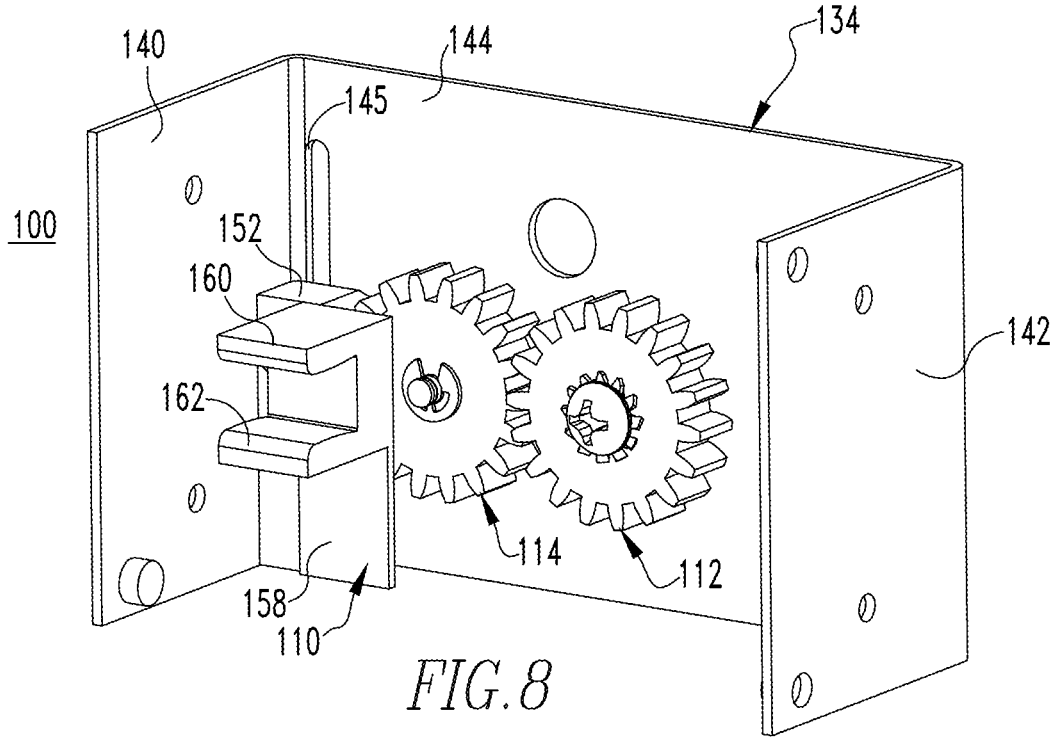
FIG. 8 is a rear isometric view of the portion of the transfer assembly of FIG. 7.
Figure 9:
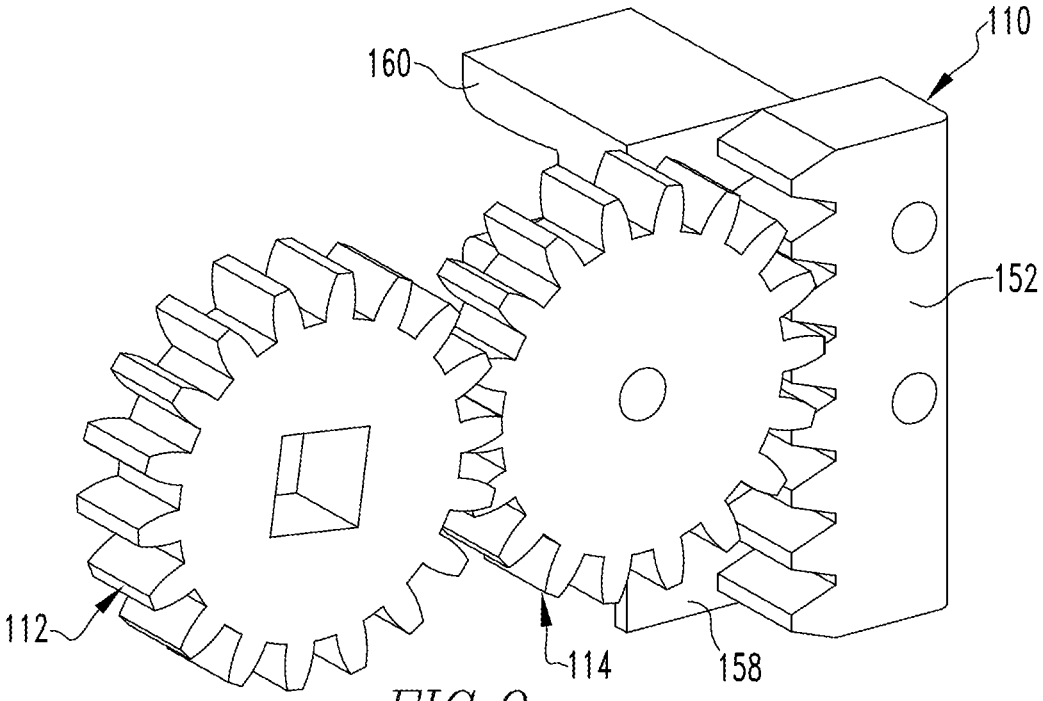
FIGS. 9 and 10 are different isometric views of a number of transfer components for the transfer assembly of FIG. 8.
Figure 10:
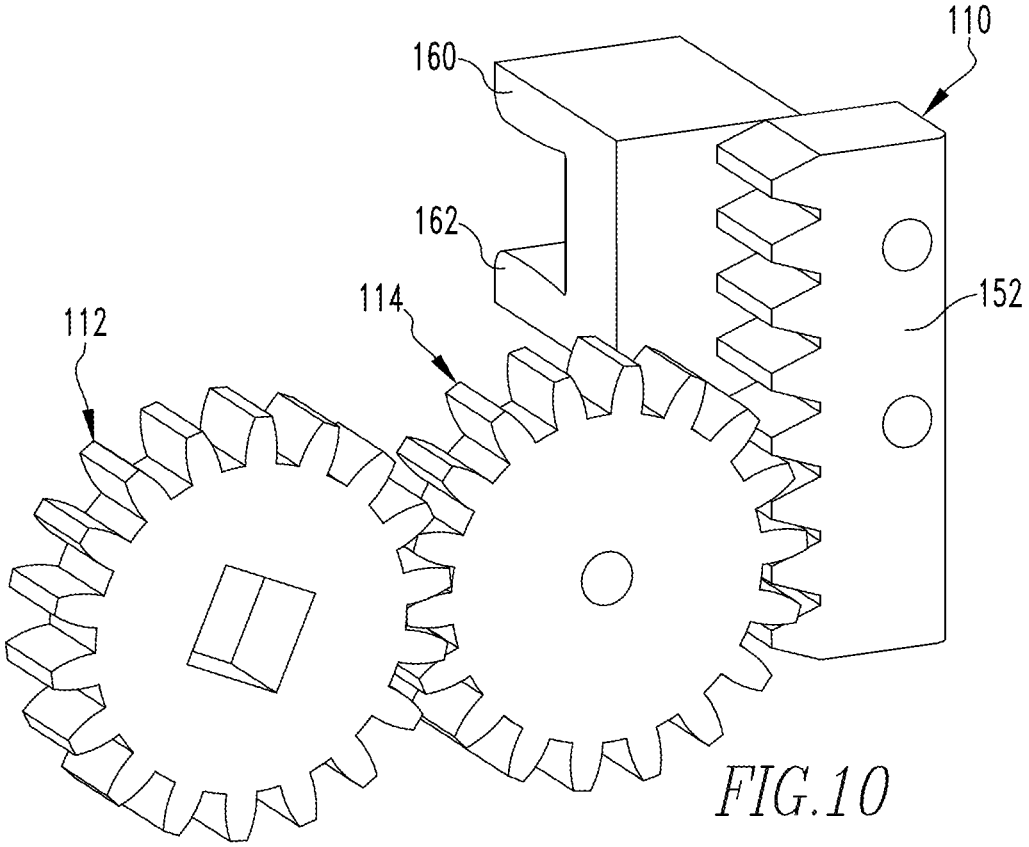
Figure 11:
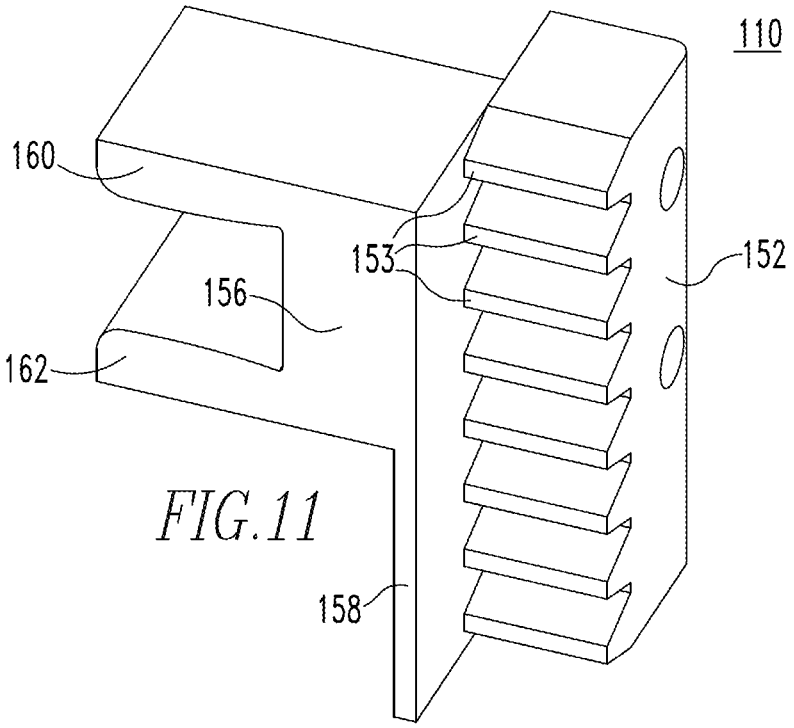
FIGS. 11 and 12 are different isometric views of one of the transfer components of FIGS. 9 and 10.
Figure 12:
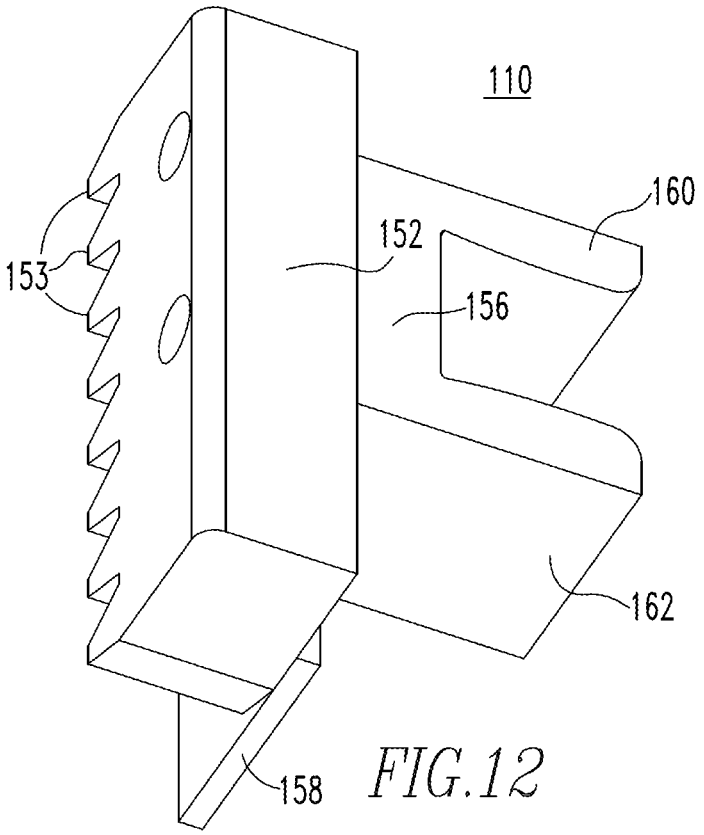

FIGS. 7 and 8 show a portion of the transfer assembly 100, FIGS. 9 and 10 show different views of the sliding member and gear members 110,112,114, and FIGS. 11 and 12 show different views of the sliding member 110. As shown in FIGS. 11 and 12, the sliding member 110 includes an elongated coupling portion 152 and a driving portion 156 extending outwardly from the coupling portion 152. It will be appreciated that the coupling portion 152 has a number of apertures (shown but not indicated) structured to receive the coupling members 136,138 (FIGS. 5 and 7), and further has a number of teeth 153 engaging and being structured to cooperate with the second gear member 114. See, for example, FIGS. 9 and 10. The driving portion 156 includes an elongated support portion 158 and a pair of opposing protrusions 160,162 extending outwardly from the support portion 158. The support portion 158 may be a planar portion that provides structural support to the elongated coupling portion 152. The sliding member 110 is preferably a unitary component made from a single piece of material (e.g., without limitation, an injection molded thermoplastic material).

FIGS. 9 and 10 correspond to the transfer components 110,112,114 moving between positions to move the operating handle 8 (FIGS. 3 and 4) between the ON and OFF positions. Accordingly, it will be appreciated that the operating handle 8 is located between the protrusions 160,162 of the sliding member 110. As such, the rotary handle 108 (FIGS. 1 and 2), which has the same axis of rotation as, and thus rotates together with, the first gear member 112, causes the second gear member 114 to rotate. When this happens, as shown in FIGS. 9 and 10, the coupling portion 152 of the sliding member 110 is moved linearly by the second gear member 114. For example, moving from FIG. 9 to FIG. 10, when the second gear member 114 rotates (e.g., rotates about a fixed axis of rotation) counterclockwise, the sliding member 110 is driven upwards linearly. In other words, the second gear member 114 engages the first gear member 112 and the sliding member 110 in order to translate rotational movement of the rotary handle 108 into linear movement of the sliding member 110. Accordingly, the sliding member 110 and the gear members 112,114 each move in a plane parallel to the third wall 144 of the support member 134 (FIGS. 5 and 7). In this manner, the second protrusion 162 is able to drive the operating handle 8 (FIGS. 3 and 4) between positions. Accordingly, the first protrusion 160 is able to drive the operating handle 8 from the ON to OFF position, and the second protrusion 162 is able to drive the operating handle 8 from the OFF to ON position.

As such, the transfer assembly 100 advantageously provides an improved mechanism to allow operators to move the operating handle 8 between ON and OFF positions. Specifically, rotation of the rotary handle 108 to open and close the separable contacts 6 (FIG. 3) is generally easier than movement of the operating handle 8 (FIGS. 3 and 4) between positions. Furthermore, by employing the support member 134, the sliding member 110 and the gear members 112,114 advantageously have an additional support structure on which to be anchored, apart from the separate and distinct housing 132.

Accordingly, it will be appreciated that the disclosed concept provides for an improved electrical switching apparatus 2 and transfer assembly 100 therefor, in which, among other benefits, a support member 134 is employed to provide support and stability to transfer components 110,112,114 of the transfer assembly 100.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof

What is claimed is:

1. A transfer assembly for an electrical switching apparatus, said electrical switching apparatus comprising a first housing, a pair of separable contacts disposed internal with respect to said first housing, and an operating handle having an ON position and an OFF position, the ON position corresponding to said separable contacts being closed, the OFF position corresponding to said separable contacts being open, said transfer assembly comprising:

a rotary handle;

a number of transfer components each structured to cooperate with said rotary handle, one of said transfer components being structured to engage said operating handle in order to allow said rotary handle to move said operating handle between the ON position and the OFF position; and a support assembly comprising a second housing and a support member coupled to and disposed internal with respect to said second housing, said second housing being structured to be coupled to said first housing, said rotary handle being coupled to said second housing, wherein each of said transfer components is coupled to said support member, wherein said support member and said second housing are separate and distinct components, wherein said one of said transfer components is a sliding member; and wherein said support assembly further comprises a number of coupling members extending through said support member and at least partially into said sliding member in order to couple said sliding member to said support member, and wherein said support member comprises a first wall, a second wall disposed opposite and generally parallel to said first wall, and a third wall extending between and being disposed generally perpendicular to said first wall and said second wall; and wherein said coupling members extend through said third wall.

2. The transfer assembly of claim 1 wherein said first wall and said second wall each engage and are substantially flush with a corresponding wall of said second housing.

3. The transfer assembly of claim 1 wherein each of said transfer components is structured to move in a plane parallel to said third wall.

4. The transfer assembly of claim 1 wherein each of said transfer components is spaced from said first wall and said second wall.

5. The transfer assembly of claim 1 wherein said support member is made of a metallic material; and wherein said second housing is made of a non-metallic material.

6. The transfer assembly of claim 1 wherein said support assembly further comprises a number of coupling members extending at least partially through said second housing and said support member in order to couple said support member to said second housing.

7. The transfer assembly of claim 1 wherein said one of said transfer components is a sliding member; wherein said number of transfer components comprises a first gear member and a second gear member cooperating with said first gear member; wherein said first gear member is coupled to and is structured to be rotated by said rotary handle; and wherein said second gear member engages said first gear member and said sliding member in order to translate rotational movement of said rotary handle into linear movement of said sliding member.

8. A transfer assembly for an electrical switching apparatus, said electrical switching apparatus comprising a first housing, a pair of separable contacts disposed internal with respect to said first housing, and an operating handle having an ON position and an OFF position, the ON position corresponding to said separable contacts being closed, the OFF position corresponding to said separable contacts being open, said transfer assembly comprising:

a rotary handle;

a number of transfer components each structured to cooperate with said rotary handle, one of said transfer components being structured to engage said operating handle in order to allow said rotary handle to move said operating handle between the ON position and the OFF position; and a support assembly comprising a second housing and a support member coupled to and disposed internal with respect to said second housing, said second housing being structured to be coupled to said first housing, said rotary handle being coupled to said second housing, wherein each of said transfer components is coupled to said support member, and wherein said support member comprises a first wall, a second wall disposed opposite and generally parallel to said first wall, and a third wall extending between and being disposed generally perpendicular to said first wall and said second wall; wherein each of said first wall and said second wall engages and is generally flush with a corresponding wall of said second housing; and wherein said one of said transfer components is disposed at or about said first wall, and opposite and distal said second wall.

9. The transfer assembly of claim 8 wherein said third wall has an elongated slot at or about a junction with said first wall; and wherein said support assembly further comprises a number of coupling members extending through the elongated slot and at least partially into said one of said transfer components.

10. An electrical switching apparatus comprising:

a first housing;

a pair of separable contacts disposed internal with respect to said first housing;

an operating handle having an ON position and an OFF position, the ON position corresponding to said separable contacts being closed, the OFF position corresponding to said separable contacts being open; and a transfer assembly comprising:

a rotary handle, a number of transfer components each structured to cooperate with said rotary handle, one of said transfer components being structured to engage said operating handle in order to allow said rotary handle to move said operating handle between the ON position and the OFF position, and a support assembly comprising a second housing and a support member coupled to and disposed internal with respect to said second housing, said second housing being structured to be coupled to said first housing, said rotary handle being coupled to said second housing, wherein each of said transfer components is coupled to said support member, wherein said support member and said second housing are separate and distinct components, wherein said one of said transfer components is a sliding member; and wherein said support assembly further comprises a number of coupling members extending through said support member and at least partially into said sliding member in order to couple said sliding member to said support member, and wherein said support member comprises a first wall, a second wall disposed opposite and generally parallel to said first wall, and a third wall extending between and being disposed generally perpendicular to said first wall and said second wall; and wherein said coupling members extend through said third wall.

11. The electrical switching apparatus of claim 10 wherein each of said transfer components is structured to move in a plane parallel to said third wall.

12. The electrical switching apparatus of claim 10 wherein said support member is made of a metallic material; and wherein said second housing is made of a non-metallic material.

13. The electrical switching apparatus of claim 10 wherein said one of said transfer components is a sliding member; wherein said number of transfer components comprises a first gear member and a second gear member cooperating with said first gear member; wherein said first gear member is coupled to and is structured to be rotated by said rotary handle; and wherein said second gear member engages said first gear member and said sliding member in order to translate rotational movement of said rotary handle into linear movement of said sliding member.

14. The electrical switching apparatus of claim 13 wherein said support member comprises a first wall, a second wall disposed opposite and generally parallel to said first wall, and a third wall extending between and being disposed generally perpendicular to said first wall and said second wall; wherein each of said first wall and said second wall engages and is generally flush with a corresponding wall of said second housing; and wherein said sliding member is disposed at or about said first wall, and opposite and distal said second wall.

* * * * *